US011183129B2

(12) United States Patent
Chen et al.

(10) Patent No.: US 11,183,129 B2
(45) Date of Patent: Nov. 23, 2021

(54) DISPLAY CONTROL METHOD AND APPARATUS, COMPUTER READABLE STORAGE MEDIUM, AND COMPUTER DEVICE

(71) Applicants: BOE Technology Group Co., Ltd., Beijing (CN); Chongqing BOE Optoelectronics Technology Co., Ltd., Chongqing (CN)

(72) Inventors: Shanbin Chen, Beijing (CN); Xu Lu, Beijing (CN); Sijun Lei, Beijing (CN); Yunsong Li, Beijing (CN); Yong Long, Beijing (CN); Xin Chen, Beijing (CN); Peng Zhang, Beijing (CN)

(73) Assignees: BOE Technology Group Co., Ltd., Beijing (CN); Chongqing BOE Optoelectronics Technology Co., Ltd., Chongqing (CN)

( * ) Notice: Subject to any disclaimer, the term of this patent is extended or adjusted under 35 U.S.C. 154(b) by 325 days.

(21) Appl. No.: 16/199,827

(22) Filed: Nov. 26, 2018

(65) Prior Publication Data

US 2019/0325830 A1 Oct. 24, 2019

(30) Foreign Application Priority Data

Apr. 23, 2018 (CN) ..... 201810368256.6

(51) Int. Cl.
*G09G 3/36* (2006.01)

(52) U.S. Cl.
CPC ..... *G09G 3/3607* (2013.01); *G09G 3/3696* (2013.01); *G09G 2320/0247* (2013.01)

(58) Field of Classification Search
CPC combination set(s) only.
See application file for complete search history.

(56) References Cited

U.S. PATENT DOCUMENTS

| | | | | |
|---|---|---|---|---|
| 2015/0325165 | A1* | 11/2015 | Mori | G09G 3/2025 345/698 |
| 2016/0189642 | A1* | 6/2016 | Shin | G09G 3/3655 345/690 |
| 2016/0284287 | A1* | 9/2016 | Cho | G09G 3/3426 |
| 2016/0300544 | A1* | 10/2016 | Ding | G09G 3/3696 |
| 2018/0061302 | A1* | 3/2018 | Hu | G09G 3/3648 |
| 2018/0261181 | A1* | 9/2018 | Lim | G09G 3/3291 |

* cited by examiner

*Primary Examiner* — Andrew Sasinowski
(74) *Attorney, Agent, or Firm* — Arent Fox LLP; Michael Fainberg

(57) ABSTRACT

The disclosure discloses a display control method and apparatus, a computer readable storage medium, and a computer device, where the display control method includes: receiving data of a frame of image to be displayed; determining proportions of numbers of sub-pixels in respective colors at nonzero grayscales in the frame of image to be displayed, according to the data of the frame of image to be displayed; determining a target common voltage value according to the determined proportions; and outputting the target common voltage value to a common electrode to display the image.

13 Claims, 6 Drawing Sheets

DISPLAY CONTROL METHOD AND APPARATUS, COMPUTER READABLE STORAGE MEDIUM, AND COMPUTER DEVICE

CROSS-REFERENCE TO RELATED APPLICATION

This Application claims priority to Chinese Patent Application No. 201810368256.6, filed on Apr. 23, 2018, the content of which is incorporated by reference in the entirety.

TECHNICAL FIELD

This disclosure relates to the field of display technologies, and particularly to a display control method and apparatus, a computer readable storage medium, and a computer device.

DESCRIPTION OF THE RELATED ART

A Liquid Crystal Display (LCD) panel, particularly a Thin Film Transistor Liquid Crystal Display (TFT-LCD) panel is a commonly-used flat panel in the related art, for example, the TFT-LCD panel is widely applied in modern digital information devices due to its advantages of small volume, low power consumption, no radiation, high resolution and the like.

However, in the related art, there may be a difference in jump voltage between sub-pixels in different colors due to a process factor, aging elements, etc., so that after an image displayed on the LCD panel is switched, a corresponding optimum common voltage value thereof may drift, thus resulting in a flicker in the image displayed on the LCD panel.

SUMMARY

Embodiments of the disclosure provide a display control method and apparatus, a computer readable storage medium, and a computer device.

In an aspect, the embodiments of the disclosure provide a display control method including: receiving data of a frame of image to be displayed; determining proportions of numbers of sub-pixels in respective colors at nonzero grayscales in the frame of image to be displayed, according to the data of the frame of image to be displayed; determining a target common voltage value according to the determined proportions; and outputting the target common voltage value to a common electrode to display the image.

In some embodiments, in the display control method above according to the embodiments of the disclosure, determining the target common voltage value according to the determined proportions includes: determining the target common voltage value according to the determined proportions and a pre-created correspondence table between proportions of numbers of sub-pixels in respective colors at nonzero grayscales, and an optimum common voltage value.

In some embodiments, in the display control method above according to the embodiments of the disclosure, the display control method further includes: creating the correspondence table between the proportions of the numbers of sub-pixels in the respective colors at nonzero grayscales, and the optimum common voltage value by: determining ideal common voltage values corresponding to the sub-pixels in the respective colors; determining a current optimum common voltage value Vcom1 corresponding to the proportions of the numbers of sub-pixels in the respective colors at nonzero grayscales in an equation of:

$$V_{com1} = \sum_{m=1}^{M} V_m * \lambda_m;$$

wherein M represents a total number of colors, m represents an integer greater than or equal to 1, and less than or equal to M, λm represents a proportion of a number of sub-pixels in one of the colors at nonzero grayscales, and Vm represents an ideal common voltage value corresponding to the sub-pixels in the one of the colors; and creating the correspondence table between the proportions of the numbers of sub-pixels in the respective colors at nonzero grayscales, and the optimum common voltage value according to the determined current optimum common voltage value.

In some embodiments, in the display control method above according to the embodiments of the disclosure, creating the correspondence table between the proportions of the numbers of sub-pixels in the respective colors at nonzero grayscales, and the optimum common voltage value according to the determined current optimum common voltage value includes: determining a common voltage output value corresponding to the current optimum common voltage value according to a plurality of different preset intervals of common voltage output values, and the determined current optimum common voltage value; and creating the correspondence table between the proportions of the numbers of sub-pixels in the respective colors at nonzero grayscales, and the optimum common voltage value according to the determined common voltage output value.

In some embodiments, in the display control method above according to the embodiments of the disclosure, before the data of the frame of image to be displayed are received, the display control method further includes: determining ideal common voltage values corresponding to the sub-pixels in the respective colors; and determining the target common voltage value according to the determined proportions includes: determining the target common voltage value according to the determined ideal common voltage values, and the determined proportions.

In some embodiments, in the display control method above according to the embodiments of the disclosure, determining the target common voltage value according to the determined ideal common voltage values, and the determined proportions includes: determining the target common voltage value in an equation of $$V_{com2} = \sum_{k=1}^{K} V_k * \lambda_k;$$

wherein K represents a total number of colors, k represents an integer greater than or equal to 1, and less than or equal to K, λk represents a proportion of a number of sub-pixels in one of the colors at nonzero grayscales, and Vk represents an ideal common voltage value corresponding to the sub-pixels in the one of the colors.

In some embodiments, in the display control method above according to the embodiments of the disclosure, determining the ideal common voltage values corresponding to the sub-pixels in the respective colors includes: controlling, for sub-pixels in each color, a liquid crystal display panel to display according to a preset grayscale and an initial common voltage value; determining an image flicker value of the liquid crystal display panel; determining whether the image flicker value satisfies a minimum flicker threshold; and determining the initial common voltage value as an ideal common voltage value corresponding to the sub-pixels in the color, upon determining that the image flicker value satisfies the minimum flicker threshold; or in response to determining that the image flicker value does not satisfy the minimum flicker threshold, adjusting the initial common voltage value, and controlling the liquid crystal display panel again to display according to the preset grayscale corresponding to the color, and the adjusted initial common voltage value, determining an image flicker value of the liquid crystal display panel again until it is determined that the determined image flicker value satisfies the minimum flicker threshold, and determining the adjusted initial common voltage value as an ideal common voltage value corresponding to the sub-pixels in the color.

In some embodiments, in the display control method above according to the embodiments of the disclosure, the display control method further includes: determining the minimum flicker threshold by: selecting a preset number of liquid crystal display panels; debugging respective selected liquid crystal display panels, and determining debug common voltage values corresponding to smallest image flicker values of the respective selected liquid crystal display panels; and determining the minimum flicker threshold according to the determined debug common voltage values corresponding to the respective selected liquid crystal display panels.

In some embodiments, in the display control method above according to the embodiments of the disclosure, the data of the frame of image to be displayed are data of an (a+1)-th frame of image, wherein a is a positive integer; and after the data of the frame of image to be displayed are received, and before the proportions of the numbers of sub-pixels in the respective colors at nonzero grayscales in the frame of image to be displayed are determined according to the data of the frame of image to be displayed, the display control method further includes: determining a difference between the data of the frame of image to be displayed, and data of the a-th frame of image; and determining the proportions of the numbers of sub-pixels in the respective colors at nonzero grayscales in the frame of image to be displayed, according to the data of the frame of image to be displayed includes: determining the proportions of the numbers of sub-pixels in the respective colors at nonzero grayscales in the frame of image to be displayed, according to the data of the frame of image to be displayed, upon determining that the difference between the data of the frame of image to be displayed, and the data of the a-th frame of image does not lie in a preset difference range.

In another aspect, the embodiments of the disclosure further provide a display control apparatus, including: a receiving circuit configured to receive data of a frame of image to be displayed; a proportion determining circuit configured to determine proportions of numbers of sub-pixels in respective colors at nonzero grayscales in the frame of image to be displayed, according to the data of the frame of image to be displayed; a voltage value determining circuit configured to determine a target common voltage value according to the determined proportions; and a driving circuit configured to output the target common voltage value to a common electrode to display the image.

In some embodiments, in the display control apparatus above according to the embodiments of the disclosure, the display control apparatus further includes: a storing circuit configured to store a pre-created correspondence table between proportions of numbers of sub-pixels in respective colors at nonzero grayscales, and an optimum common voltage value; and the voltage value determining circuit is configured to determine the target common voltage value according to the determined proportions, and the pre-created correspondence table between the proportions of the numbers of sub-pixels in the respective colors at nonzero grayscales, and the optimum common voltage value.

In some embodiments, in the display control apparatus above according to the embodiments of the disclosure, the display control apparatus further includes: an obtaining circuit configured to determine ideal common voltage values corresponding to the sub-pixels in the respective colors; and the voltage value determining circuit is configured to determine the target common voltage value according to the determined ideal common voltage values, and the determined proportions.

In some embodiments, in the display control apparatus above according to the embodiments of the disclosure, the voltage value determining circuit is configured to determine the target common voltage value Vcom2 in an equation of:

$$V_{com2} = \sum_{k=1}^{K} V_k * \lambda_k;$$

wherein K represents a total number of colors, k represents an integer greater than or equal to 1, and less than or equal to K, λk represents a proportion of a number of sub-pixels in one of the colors at nonzero grayscales, and Vk represents an ideal common voltage value corresponding to the sub-pixels in the one of the colors.

In some embodiments, in the display control apparatus above according to the embodiments of the disclosure, the data of the frame of image to be displayed are data of an (a+1)-th frame of image, wherein a is a positive integer; and the display control apparatus further includes: a difference determining circuit configured to determine a difference between the data of the frame of image to be displayed, and data of the a-th frame of image; and the proportion determining circuit is configured to determine the proportions of the numbers of sub-pixels in the respective colors at nonzero grayscales in the frame of image to be displayed, according to the data of the frame of image to be displayed, upon determining that the difference between the data of the frame of image to be displayed, and the data of the a-th frame of image does not lie in a preset difference range.

In still another aspect, the embodiments of the disclosure further provide a display device, including a display control apparatus; wherein the display control apparatus includes: a receiving circuit configured to receive data of a frame of image to be displayed; a proportion determining circuit configured to determine proportions of numbers of sub-pixels in respective colors at nonzero grayscales in the frame of image to be displayed, according to the data of the frame of image to be displayed; a voltage value determining circuit configured to determine a target common voltage value according to the determined proportions; and a driving circuit configured to output the target common voltage value to a common electrode to display the image.

In some embodiments, in the display device above according to the embodiments of the disclosure, the display control apparatus further includes: a storing circuit configured to store a pre-created correspondence table between proportions of numbers of sub-pixels in respective colors at nonzero grayscales, and an optimum common voltage value; and the voltage value determining circuit is configured to determine the target common voltage value according to the determined proportions, and the pre-created correspondence table between the proportions of the numbers of sub-pixels in the respective colors at nonzero grayscales, and the optimum common voltage value.

In some embodiments, in the display device above according to the embodiments of the disclosure, the display control apparatus further includes: an obtaining circuit configured to determine ideal common voltage values corresponding to the sub-pixels in the respective colors; and the voltage value determining circuit is configured to determine the target common voltage value according to the determined ideal common voltage values, and the determined proportions.

In some embodiments, in the display device above according to the embodiments of the disclosure, the data of the frame of image to be displayed are data of an (a+1)-th frame of image, wherein a is a positive integer; and the display control apparatus further includes: a difference determining circuit configured to determine a difference between the data of the frame of image to be displayed, and data of the a-th frame of image; and the proportion determining circuit is configured to determine the proportions of the numbers of sub-pixels in the respective colors at nonzero grayscales in the frame of image to be displayed, according to the data of the frame of image to be displayed, upon determining that the difference between the data of the frame of image to be displayed, and the data of the a-th frame of image does not lie in a preset difference range.

In yet another aspect, the embodiments of the disclosure further provide a computer readable storage medium, wherein computer readable program codes are stored on the computer readable storage medium, and the computer readable program codes are configured to enable a processor to perform operations of the display control method according to the embodiments of the disclosure, when the computer readable program codes run on the processor.

In a further aspect, the embodiments of the disclosure further provide a computer device, comprising a memory and at least one processor, wherein computer readable program codes are stored on the memory, and the at least one processor is configured to execute the computer readable program codes to perform operations of the display control method according to the embodiments of the disclosure.

BRIEF DESCRIPTION OF THE DRAWINGS

In order to make the technical solutions according to the embodiments of the disclosure more apparent, the drawings to which a description of the embodiments refers will be briefly introduced below, and apparently the drawings to be described below are merely illustrative of some of the embodiments of the disclosure, and those ordinarily skilled in the art can derive from these drawings other drawings without any inventive effort.

DETAILED DESCRIPTION OF THE EMBODIMENTS

Figure 1:
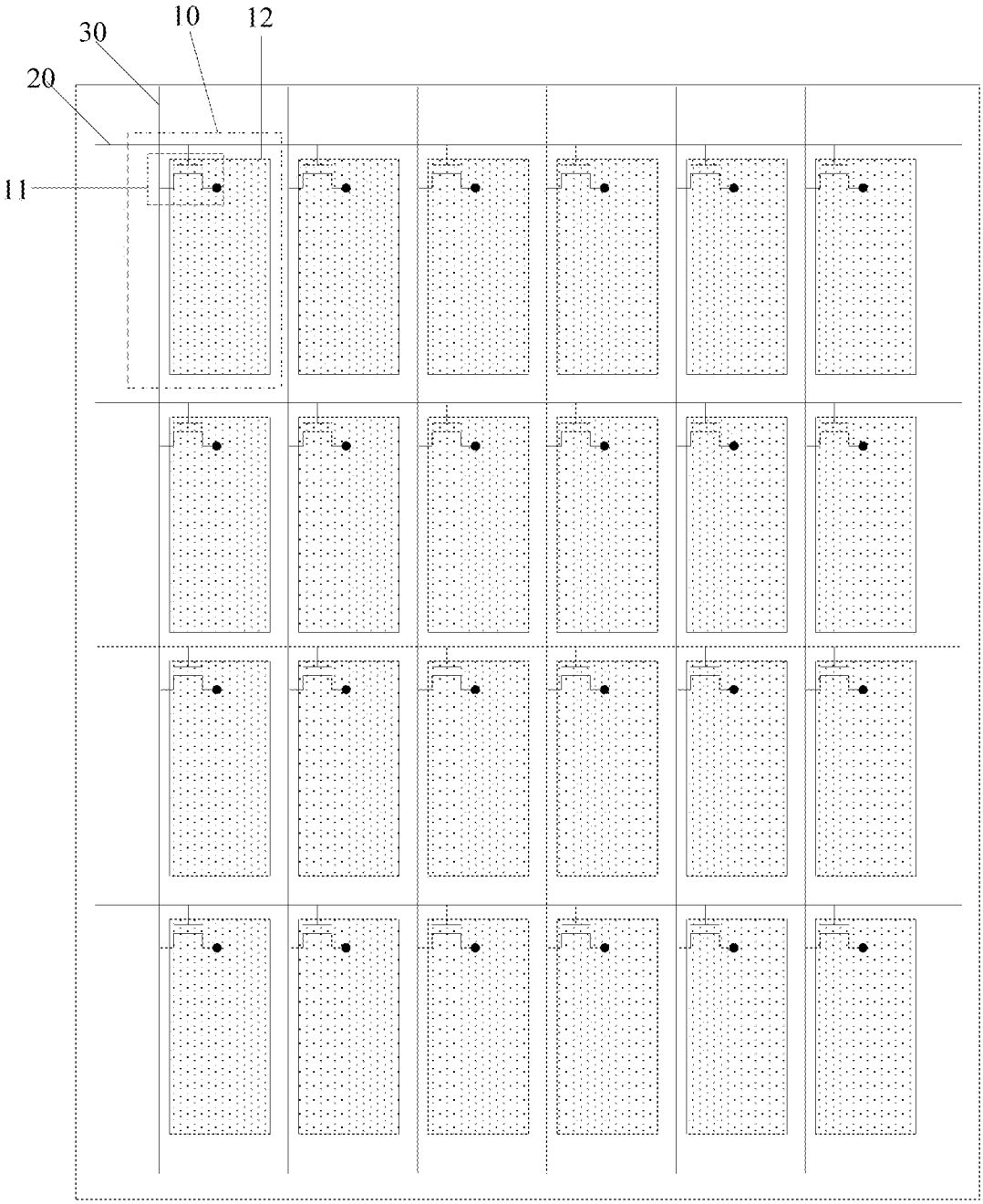
FIG. 1 is a schematic structural diagram of a liquid crystal display panel in the related art.
Figure 2:
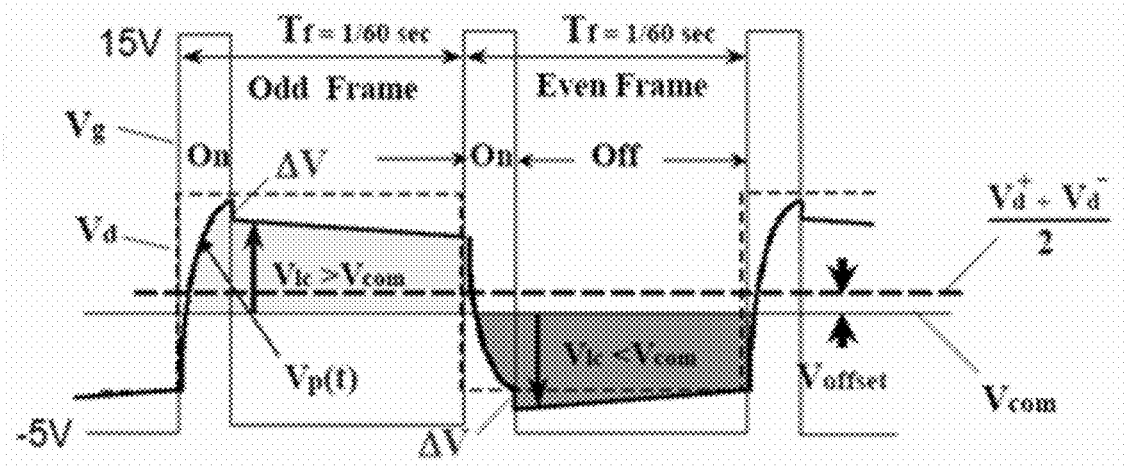
FIG. 2 is a waveform diagram of a driving signal in the related art.

As illustrated in FIG. 1, a LCD panel in the related art generally includes sub-pixels 10, gate lines 20, and data lines 30, where each sub-pixel 10 typically includes a Thin Film Transistor (TFT) 11, and a pixel electrode 12 configured to apply voltage to liquid crystal molecules. While an image is being displayed on the LCD panel, as illustrated in FIG. 2 showing a signal waveform thereof, firstly gate-on voltage at a high level (e.g., 15V) is applied to a gate line, that is, the high-level voltage is applied to a gate of a TFT to turn on the TFT so that a data signal is input to a pixel electrode; and then gate off-voltage at a low level (e.g., −5V) is applied to the gate line to turn off the TFT. However while the TFT which is turned on is being turned off, there may be a jump of voltage across the liquid crystal, which is generally referred to as jump voltage $\Delta V_p$, where $$\Delta V_p = \frac{C_{gs}}{C_{lc} + C_{st} + C_{gs}} \times (VGH - VGL),$$

where VGH represents the gate-on voltage, VGL represents the gate-off voltage, $C_{gs}$ represents a gate-source capacitance of the TFT, $C_k$ represents a liquid crystal capacitance, and $C_{st}$ represents a storage capacitance of the pixel electrode. The sub-pixels generally include red sub-pixels, green sub-pixels, and blue sub-pixels. There may be a difference in $\Delta V_p$ between sub-pixels in different colors due to a process factor, aging elements, etc., so that after the image displayed on the LCD panel is switched, a corresponding optimum common voltage value thereof may drift, thus resulting in a flicker in the image displayed on the LCD panel.

Embodiments of the disclosure provide a display control method and apparatus, a computer readable storage medium, and a computer device, so as to alleviate the problem of a flicker in the image displayed on the LCD panel.

It shall be noted that, an interval of varying brightness from the lowest to the highest brightness is generally divided into a plurality of grayscales to thereby control the brightness on a screen. For example, a displayed image can generally include components in three colors of red, green, and blue, which are mixed into a color image, where the components in the respective colors can appear at different brightness levels, and the red, green, and blue components at the different brightness levels can be mixed into different color dots. The grayscales represent the different levels of brightness between the lowest to the highest brightness. If there are a larger number of intermediate levels, then the image will be displayed at a finer granularity. In the related art, an image generally can be displayed on an LCD using a 6-bit ($2^6$ brightness levels, i.e., 64 grayscales) panel, a 7-bit ($2^7$ brightness levels, i.e., 128 grayscales) panel, a 8-bit ($2^8$ brightness levels, i.e., 256 grayscales) panel, a 10-bit ($2^{10}$ brightness levels, i.e., 1024 grayscales) panel, a 12-bit ($2^{12}$ brightness levels, i.e., 4096 grayscales) panel, a 16-bit ($2^{16}$ brightness levels, i.e., 65536 grayscales) panel, etc. A liquid crystal display panel including red sub-pixels, green sub-pixels, and blue sub-pixels will be described below by way of an example, but it shall be appreciated that the colors of the sub-pixels in the liquid crystal display will not be limited thereto.

In order to make the objects, technical solutions, and advantages of the disclosure more apparent, the implementations of the display control method and apparatus, the computer readable storage medium, and the computer device according to the embodiments of the disclosure will be described below in details with reference to the drawings. It shall be appreciated that the embodiments to be described below are only intended to illustrate and explain the disclosure, but not to limit the disclosure thereto. Furthermore the embodiments of the disclosure and the features in the embodiments can be combined with each other unless they conflict with each other.

Figure 3:
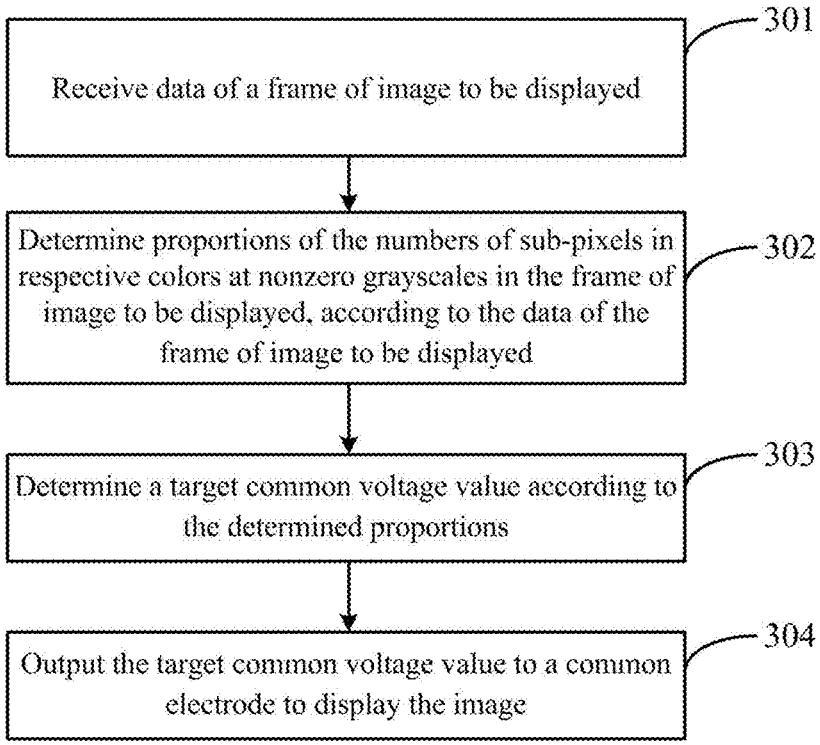
FIG. 3 is a flow chart of a display control method according to the embodiments of the disclosure.

As illustrated in FIG. 3, a display control method according to the embodiments of the disclosure includes the following operations.

The operation S301 is to receive data of a frame of image to be displayed.

In some embodiments, the data of the frame of image to be displayed generally include components of an image to be formed. For example, the data of the frame of image to be displayed include respective red sub-pixels and their corresponding grayscales, respective green sub-pixels and their corresponding grayscales, and respective blue sub-pixels and their corresponding grayscales.

The operation S302 is to determine proportions of the numbers of sub-pixels in respective colors at nonzero grayscales in the frame of image to be displayed, according to the data of the frame of image to be displayed.

Where the proportions are absolute proportions or are represented as percentages.

Taking a liquid crystal display panel with 256 grayscales as an example, a grayscale 0 represents the lowest grayscale, i.e., a grayscale at which the blackest image is displayed on the liquid crystal display panel, and a grayscale 255 represents the highest grayscale, i.e., a grayscale at which the whitest image is displayed on the liquid crystal display panel. In some embodiments, the number of red sub-pixels at nonzero grayscales in the frame of image to be displayed is the number of red sub-pixels at corresponding grayscales 1 to 255, which are input while an image is being displayed on the liquid crystal display panel according to the data of the frame of image to be displayed, and for example, the number is represented as $S_r$. Alike, the number of green sub-pixels at nonzero grayscales in the frame of image to be displayed is the number of green sub-pixels at corresponding input grayscales 1 to 255, and for example, the number is represented as $S_g$; and the number of blue sub-pixels at nonzero grayscales in the frame of image to be displayed is the number of blue sub-pixels at corresponding input grayscales 1 to 255, and for example, the number is represented as $S_b$. Then the proportions of the numbers of sub-pixels in the respective colors at nonzero grayscales can be $S_r$:$S_g$: $S_b$.

Further, the proportion of the number of red sub-pixels at nonzero grayscales can alternatively be represented as a percentage:

$$\frac{S_r}{S_r + S_g + S_b} \times 100\%,$$

and the same representation can also apply to the other sub-pixels, so a repeated description thereof will be omitted here. Further, it shall be noted that, the following description will be given with the proportions which are percentages.

The operation S303 is to determine a target common voltage value according to the determined proportions.

The operation S304 is to output the target common voltage value to a common electrode to display the image.

In the display control method according to the embodiments of the disclosure, an image can be controlled to be displayed on the liquid crystal display panel in such a way that the proportions of the numbers of sub-pixels in the respective colors at nonzero grayscales in the frame of image to be displayed are determined according to the data of the frame of image to be displayed, and further the optimum target common voltage value adapted to the frame of image to be displayed is determined according to the determined proportions, so that the image can be displayed on the LCD panel using the determined target common voltage value while the image is being switched, thus alleviating the problem of a flicker in the displayed image.

In some embodiments, a target common voltage value adapted to data of each frame of image to be displayed can be determined using the display control method according to the embodiments of the disclosure to thereby alleviate a flicker in the image. Images to be displayed on the LCD panel can generally include static and dynamic images. While a static image is being displayed on the LCD panel, if a target common voltage value is determined for data of each frame of image to be displayed, then power consumption will be increased, so in some embodiments, the data of the frame of image to be displayed can be data of the (a+1)-th frame of image, where a is a positive integer. And after the data of the frame of image to be displayed are received, and before the proportions of the numbers of sub-pixels in the respective colors at nonzero grayscales in the frame of image to be displayed are determined according to the data of the frame of image to be displayed, the method further includes: determining a difference between the data of the frame of image to be displayed, and data of the a-th frame of image.

Accordingly, determining the proportions of the numbers of sub-pixels in the respective colors at nonzero grayscales in the frame of image to be displayed, according to the data of the frame of image to be displayed includes: determining the proportions of the numbers of sub-pixels in the respective colors at nonzero grayscales in the frame of image to be displayed, according to the data of the frame of image to be displayed, upon determining that the difference between the data of the frame of image to be displayed, and the data of the a-th frame of image does not lie in a preset difference range. Stated otherwise, if it is determined that the difference between the data of the frame of image to be displayed, and the data of the a-th frame of image lies in the preset difference range, then the operation of determining the proportions of the numbers of sub-pixels in the respective colors at nonzero grayscales in the frame of image to be displayed, and the subsequent operations will not be performed. In this way, when it is determined the difference between the data of the frame of image to be displayed, and the data of the a-th frame of image does not lie in the preset difference range, it can be determined that these two frames of images are different, and a static image may be switched into another static image, or a static image may be switched into a dynamic image, or a dynamic image may be switched into another dynamic image. At this time, if the operation of determining the proportions of the numbers of sub-pixels in the respective colors at nonzero grayscales in the frame of image to be displayed, and the subsequent operations are further performed, then power consumption may be lowered. In some embodiments, the preset difference range can be an allowable error range. Of course, the preset difference range can be determined as needed in a practical application, although the embodiments of the disclosure will not be limited thereto.

In some embodiments, the data of the frame of image to be displayed can alternatively be data of the first frame of image, and at this time, the operations S302 to S304 may be performed directly; or the operations S302 to S304 may not be performed, but the image can be displayed using default common voltage.

In some embodiments, in the display control method according to the embodiments of the disclosure, the received data of the frame of image to be displayed is stored upon reception of the data of the frame of image to be displayed.

In some embodiments, in the display control method according to the embodiments of the disclosure, outputting the target common voltage value to the common electrode to display the image includes: converting the data of the frame of image to be displayed, into grayscale voltage for displaying, and converting the target common voltage value into common voltage for displaying; and inputting the resulting grayscale voltage to pixel electrodes in respective sub-pixels, and outputting the resulting common voltage to the common electrode to display the image.

Generally the data of the frame of image to be displayed are received, analyzed, and processed by a Timing Controller (TCON), and output by a source drive Integrated Circuit (IC). Furthermore, the TCON generally transmits the determined target common voltage value to a common voltage drive IC, e.g., a Power Management Integrated Circuit (PMIC), in a hexadecimal pattern according to an $I^2C$ protocol so that the common voltage drive IC outputs the common voltage for displaying.

The disclosure will be described below in details in connection with particular embodiments thereof. It shall be noted that these embodiments are only intended to better illustrate the disclosure, but not to limit the disclosure thereto.

In some embodiments, determining the target common voltage value according to the determined proportions includes: determining the target common voltage value according to the determined proportions and a pre-created correspondence table between proportions of the numbers of sub-pixels in respective colors at nonzero grayscales, and an optimum common voltage value.

In some embodiments, the pre-created correspondence table between the proportions of the numbers of sub-pixels in the respective colors at nonzero grayscales, and the optimum common voltage value is as depicted in Table 1, where $\lambda_1$ represents a proportion corresponding to the number of red sub-pixels at nonzero grayscales in the image to be displayed, i.e., $$\lambda_1 = \frac{S_r}{S_r + S_g + S_b} \times 100\%;$$

$\lambda_2$ represents a proportion corresponding to the number of green sub-pixels at nonzero grayscales in the image to be displayed, i.e., $$\lambda_2 = \frac{S_g}{S_r + S_g + S_b} \times 100\%;$$

$\lambda_3$ represents a proportion corresponding to the number of blue sub-pixels at nonzero grayscales in the image to be displayed, i.e., $$\lambda_3 = \frac{S_b}{S_r + S_g + S_b} \times 100\%;$$

and $V_{com0}$ represents the optimum common voltage value corresponding to $\lambda_1$, $\lambda_2$, and $\lambda_3$. In this way, after the proportions of the numbers of sub-pixels in the respective colors at nonzero grayscales in the frame of image to be displayed, e.g., $\lambda_1$=75%, $\lambda_2$=0%, and $\lambda_3$=25%, are determined according to the data of the frame of image to be displayed, Table 1 is searched for an optimum common voltage value $V_{com0}$=3.175V corresponding thereto, and the found optimum common voltage value $V_{com0}$=3.175V is determined as a target common voltage value, so that the image is displayed according to the data of the frame of image to be displayed, and the determined target common voltage value 3.175V. It shall be noted that, if a value exactly corresponding to the determined proportions of the numbers of sub-pixels in the respective colors fails to be found in Table 1, then a real target common voltage value corresponding to the proportions of the numbers of sub-pixels in the respective colors may be determined through the method of approximation, fitting, or difference. In this way, while the image displayed on the LCD panel is being switched, an optimum common voltage value adapted to corresponding data in the different colors among the data of the frame of image to be displayed can be determined to thereby address a flicker while the image is being displayed. It shall be noted that, the correspondence table will be described below only by way of an example, but it shall be appreciated that the correspondence table will not be limited thereto.

Table 1 is as follows.

| $\lambda_1$ | $\lambda_2$ | $\lambda_3$ | $V_{com0}$ |
|---|---|---|---|
| 0 | 0 | 100 | 3.1 V |
| 25% | 0 | 75% | 3.125 V |
| 50% | 0 | 50% | 3.15 V |
| 75% | 0 | 25% | 3.175 V |
| 100% | 0 | 0% | 3.2 V |
| 0% | 25% | 75% | 3.075 V |
| 25% | 25% | 50% | 3.1 V |
| 50% | 25% | 25% | 3.125 V |
| 75% | 25% | 0% | 3.15 V |
| 0% | 50% | 50% | 3.05 V |
| 25% | 50% | 25% | 3.075 V |
| 50% | 50% | 0% | 3.1 V |
| 0% | 75% | 25% | 3.025 V |
| 25% | 75% | 0% | 3.05 V |
| 0% | 100% | 0% | 3.0 V |

In some embodiments, the display control method according to the embodiments of the disclosure further includes: creating the correspondence table between the proportions of the numbers of sub-pixels in the respective colors at nonzero grayscales, and the optimum common voltage value.

Figure 4:
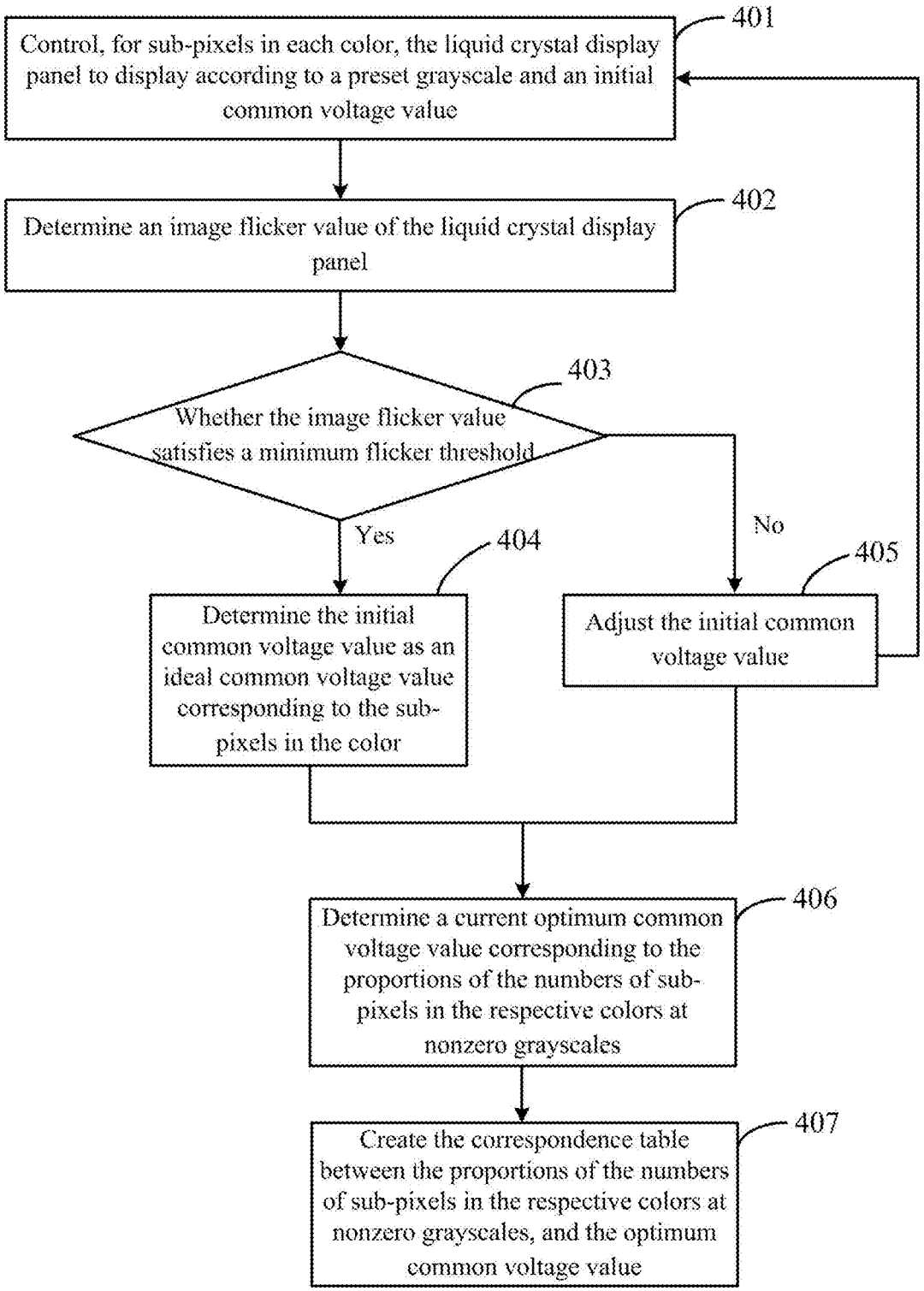
FIG. 4 is a flow chart of creating a correspondence table between proportions of the numbers of sub-pixels in respective colors at nonzero grayscales, and an optimum common voltage value according to the embodiments of the disclosure.

In some embodiments, as illustrated in FIG. 4, the correspondence table between the proportions of the numbers of sub-pixels in the respective colors at nonzero grayscales, and the optimum common voltage value can be created in the following operations.

The operation S401 is to control, for sub-pixels in each color, the liquid crystal display panel to display according to a preset grayscale and an initial common voltage value. Where the preset grayscale can be selected as one of the grayscales of the LCD panel, and for example, if the LCD panel is a panel with 256 grayscales, then the preset grayscale may be selected as one of the 256 grayscales. In a practical application, in order to facilitate recognition, the preset grayscale can be a grayscale at the middle of the grayscales of the corresponding LCD panel, and for example, if the LCD panel is a panel with 256 grayscales, then the preset grayscale may be a grayscale 127. Furthermore the initial common voltage value can be an empirically derived common voltage value. Of course, the initial common voltage value can be determined as needed in a practical application, although the embodiments of the disclosure will not be limited thereto.

In some embodiments, taking red sub-pixels as an example, a red image is displayed on the LCD panel according to the grayscale 127 and the initial common voltage value.

The operation S402 is to determine an image flicker value of the liquid crystal display panel.

In some embodiments, taking red sub-pixels as an example, the image flicker value of the liquid crystal display panel displaying the red image is determined. Where the image flicker value thereof can be determined by observing the LCD panel using human eyes, or the image flicker value can be determined by detecting the LCD panel using an image flicker detector, although the embodiments of the disclosure will not be limited thereto.

The operation S403 is to determine whether the image flicker value satisfies a minimum flicker threshold, and if so, to proceed to the operation S404; otherwise, to proceed to the operation S405.

In some embodiments, the minimum flicker threshold can be determined as follows: a preset number of liquid crystal display panels are selected; thereafter respective selected liquid crystal display panels are debugged, and debug common voltage values corresponding to the smallest image flicker values of the respective selected liquid crystal display panels are determined; and then the minimum flicker threshold is determined according to the determined debug common voltage values corresponding to the respective selected liquid crystal display panels. In some embodiments, in a practical application, for a batch of LCD panels of the same model to be adjusted, three to five LCD panels can be selected from the LCD panels to be adjusted, as panels to be debugged; and for one of the selected panels to be debugged, a common voltage value of the panel is adjusted manually in some direction, and if an image flicker value of the panel increases while the common voltage value of the panel is being debugged, then the common voltage value of the panel will be adjusted in an opposite direction, and there will be a lowest point of the image flicker value while the common voltage value is being adjusted in the opposite direction, so the common voltage value corresponding to the image flicker value at the lowest point will be determined as an optimum debug common voltage value corresponding to the panel. If there is a lowest point of the image flicker value while the common voltage value of the panel is being debugged, then the common voltage value corresponding to the image flicker value at the lowest point will be determined as an optimum debug common voltage value corresponding to the panel. Alike, optimum debug common voltage values corresponding to the other panels to be debugged can be determined. Thereafter all the determined optimum debug common voltage values are averaged, and the average is determined as the minimum flicker threshold. Of course, the smallest one of the determined debug common voltage values can alternatively be determined as the minimum flicker threshold, although the embodiments of the disclosure will not be limited thereto. There may be different application environments and display effects of different models of LCD panels so that there are different requirements on image flicker values of the LCD panels. In a practical application, the minimum flicker threshold shall be determined as needed in a practical application, although the embodiments of the disclosure will not be limited thereto.

The operation S404 is to determine the initial common voltage value as an ideal common voltage value corresponding to the sub-pixels in the color.

In some embodiments, taking red sub-pixels as an example, the initial common voltage value can be determined as an ideal common voltage value corresponding to the red sub-pixels.

The operation S405 is to adjust the initial common voltage value, to control the liquid crystal display panel again to display according to the preset grayscale corresponding to the color, and the adjusted initial common voltage value; to determine an image flicker value of the liquid crystal display panel again until it is determined that the determined image flicker value satisfies the minimum flicker threshold, and to determine the adjusted initial common voltage value as an ideal common voltage value corresponding to the sub-pixels in the color.

In some embodiments, taking red sub-pixels as an example, the adjusted initial common voltage value can be determined as an ideal common voltage value corresponding to the red sub-pixels.

Alike, ideal common voltage values corresponding to the green sub-pixels and the blue sub-pixels can be determined respectively in the operations S401 to S405.

The operation S406 is to determine a current optimum common voltage value $V_{com1}$ corresponding to the proportions of the numbers of sub-pixels in the respective colors at nonzero grayscales in an equation of:

$$V_{com1} = \sum_{m=1}^{M} V_m * \lambda_m.$$

Where M represents a total number of colors, m represents an integer greater than or equal to 1, and less than or equal to M, $\lambda_m$ represents a proportion of the number of sub-pixels in one of the colors at nonzero grayscales, and $V_m$ represents an ideal common voltage value corresponding to the sub-pixels in the one of the colors. Where $\lambda_m$ can be an empirically derived proportion, and can be determined as needed in a practical application, although the embodiments of the disclosure will not be limited thereto.

In some embodiments, with M=3, $\lambda_1$ represents a proportion corresponding to the number of red sub-pixels at nonzero grayscales in the image to be displayed, and $V_1$ represents an ideal common voltage value corresponding to the red sub-pixels; $\lambda_2$ represents a proportion corresponding to the number of green sub-pixels at nonzero grayscales in the image to be displayed, and $V_2$ represents an ideal common voltage value corresponding to the green sub-pixels; and $\lambda_3$ represents a proportion corresponding to the number of blue sub-pixels at nonzero grayscales in the image to be displayed, and $V_3$ represents an ideal common voltage value corresponding to the blue sub-pixels, so that a value of $V_{com1}$ can be determined in an equation of $V_{com1}=V_1*\lambda_1+V_2*\lambda_2+V_3*\lambda_3$. Of course, the current optimum common voltage value can alternatively be determined according to the proportions $\lambda_1$, $\lambda_1$, and $\lambda_3$, and the ideal common voltage values $V_1$, $V_2$, and $V_3$ through the method of difference, fitting, or approximation, etc., although the embodiments of the disclosure will not be limited thereto.

The operation S407 is to create the correspondence table between the proportions of the numbers of sub-pixels in the respective colors at nonzero grayscales, and the optimum common voltage value according to the determined current optimum common voltage value.

A plurality of values of $V_{com1}$ can be determined in the operation S406 so that the correspondence table between the proportions of the numbers of sub-pixels in the respective colors at nonzero grayscales, and the optimum common voltage value, e.g., the correspondence table as depicted in Table 1, can be created according to $V_{com1}$ (equivalent to $V_{com0}$ in Table 1) and corresponding $\lambda_1$, $\lambda_1$, and $\lambda_3$.

It shall be noted that, the above embodiments of the disclosure only illustrate one implementation in which the correspondence table is created, and can be modified by those skilled in the art as needed, and for example, the ideal common voltage values corresponding to the sub-pixels in the respective colors can be determined before the data of the frame of image to be displayed is received, or after the display device is delivered from a factory, although a repeated description thereof will be omitted here.

Figure 5:
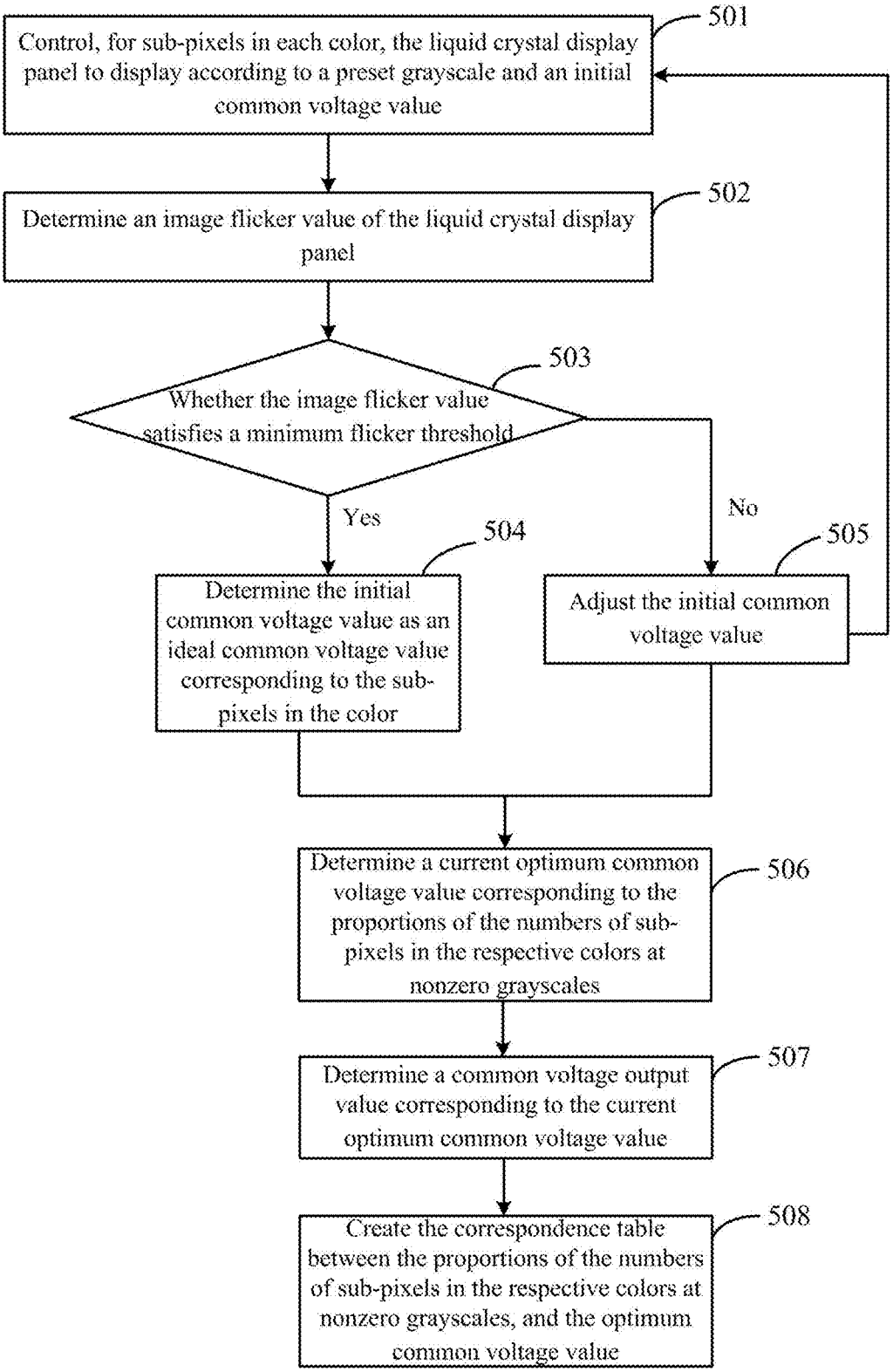
FIG. 5 is another flow chart of creating a correspondence table between proportions of the numbers of sub-pixels in respective colors at nonzero grayscales, and an optimum common voltage value according to the embodiments of the disclosure.

In some embodiments, as illustrated in FIG. 5, the correspondence table between the proportions of the numbers of sub-pixels in the respective colors at nonzero grayscales, and the optimum common voltage value can also be created in the operations S501 to S506, and the operations S507~S508, where the operations S501 to S506 are the same as the operations S401 to S406 respectively, so a repeated description thereof will be omitted here.

In some embodiments, as illustrated in FIG. 5, the operations S507~S508 are as follows.

The operation S507 is to determine a common voltage output value corresponding to the current optimum common voltage value according to a plurality of different preset intervals of common voltage output values, and the determined current optimum common voltage value; where each interval of common voltage output values corresponds to one common voltage output value.

In some embodiments, an interval of common voltage output values can be an interval generated according to a corresponding common voltage output value $V_{com\text{-}out}$ and an extension value $\Delta V$. For example, the generated interval can be $[V_{com\text{-}out}-\Delta V, V_{com\text{-}out}+\Delta V]$, or $[V_{com\text{-}out}-\Delta V, V_{com\text{-}out}+\Delta V)$, or $(V_{com\text{-}out}-\Delta V, V_{com\text{-}out}+\Delta V]$, where $\Delta V$ may be 0.025V. Of course, the interval of common voltage output values and the extension value can be determined as needed in a practical application, although the embodiments of the disclosure will not be limited thereto.

In a practical application, since the common voltage drive IC can only adjust the common voltage with limited precision, for example, the minimum adjustment precision thereof is 0.05V, when the determined value of $V_{com1}$ is 3.075V, 3.125V, 3.175V, or another value beyond the adjustment precision as depicted in Table 1, it cannot be output by the common voltage drive IC.

Accordingly in the embodiments of the disclosure, the common voltage output value $V_{com\text{-}out}$ can be set with the adjustment precision of the common voltage drive IC. For example, $V_{com\text{-}out}$ can take the following values respectively: 3.00V, 3.05V, 3.10V, 3.15V, and 3.20V, and $\Delta V$=0.025V, so the corresponding intervals of common voltage output values can be set to be [2.975, 3.025), [3.025, 3.075), [3.075, 3.125), [3.125, 3.175), and [3.175, 3.225) respectively. Thus with $V_{com1}$=3.125V, the common voltage output value $V_{com\text{-}out}$=3.15V can be determined according to the interval above. The same will apply to $V_{com\text{-}out}$ corresponding to other $V_{com1}$, so a repeated description thereof will be omitted here. In this way, the determined target common voltage value can correspond to a voltage value which can be output by the common voltage drive IC.

The operation S508 is to create the correspondence table between the proportions of the numbers of sub-pixels in the respective colors at nonzero grayscales, and the optimum common voltage value $V_{com0}$ according to the determined common voltage output value.

In some embodiments, the correspondence table as depicted in Table 2 can be created according to determined $V_{com\text{-}out}$ (equivalent to $V_{com0}$), and the proportions $\lambda_1$, $\lambda_2$, and $\lambda_3$.

Table 2 is as follows.

| $\lambda_1$ | $\lambda_2$ | $\lambda_3$ | $V_{com0}$ |
|---|---|---|---|
| 0 | 0 | 100 | 3.10 V |
| 25% | 0 | 75% | 3.15 V |
| 50% | 0 | 50% | 3.15 V |
| 75% | 0 | 25% | 3.20 V |
| 100% | 0 | 0% | 3.20 V |
| 0% | 25% | 75% | 3.10 V |
| 25% | 25% | 50% | 3.10 V |
| 50% | 25% | 25% | 3.15 V |
| 75% | 25% | 0% | 3.15 V |
| 0% | 50% | 50% | 3.05 V |
| 25% | 50% | 25% | 3.10 V |
| 50% | 50% | 0% | 3.10 V |
| 0% | 75% | 25% | 3.05 V |
| 25% | 75% | 0% | 3.05 V |
| 0% | 100% | 0% | 3.00 V |

In some embodiments, before the data of the frame of image to be displayed are received, the display control method further includes: determining ideal common voltage values corresponding to the sub-pixels in the respective colors. Where the ideal common voltage values corresponding to the sub-pixels in the respective colors can be determined while detecting the LCD panel.

Figure 6:
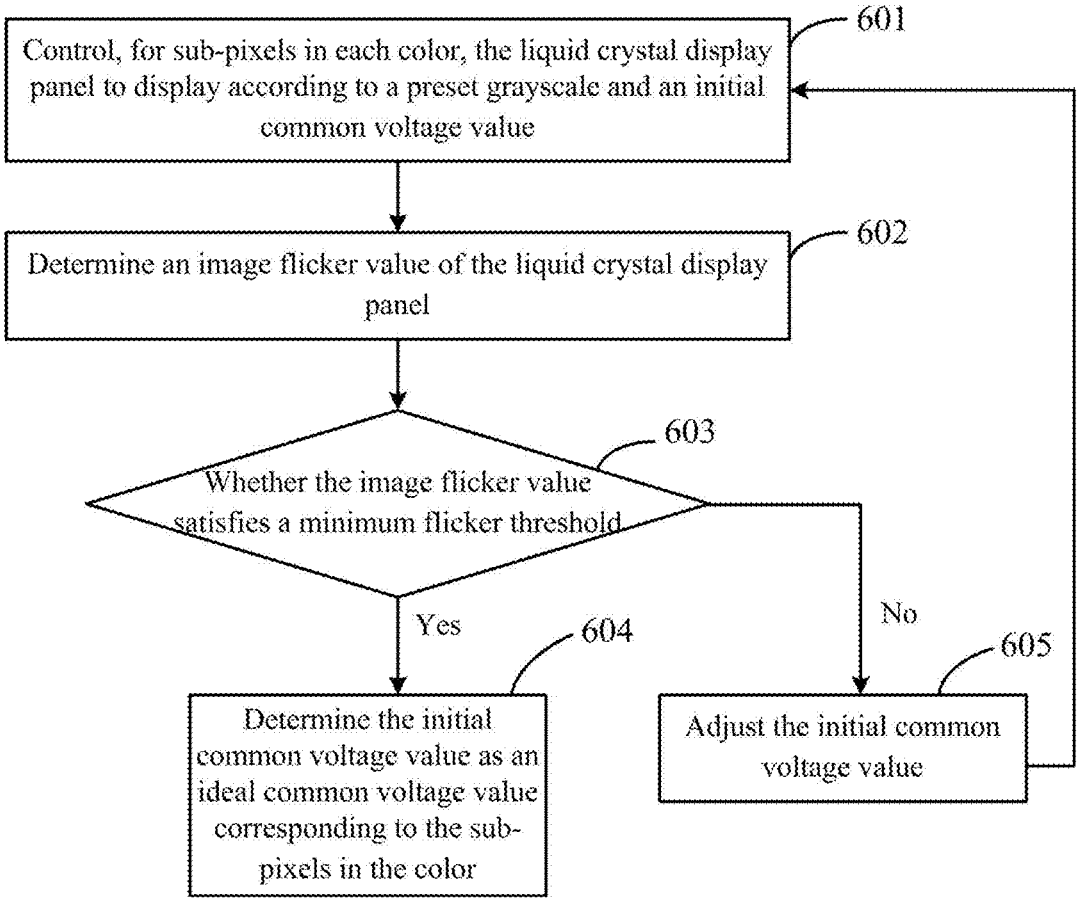
FIG. 6 is a flow chart of determining ideal common voltage values corresponding to respective colors according to the embodiments of the disclosure.

In some embodiments, in the display control method according to the embodiments of the disclosure, as illustrated in FIG. 6, the ideal common voltage values corresponding to the sub-pixels in the respective colors are determined in the following operations.

The operation S601 is to control, for sub-pixels in each color, the liquid crystal display panel to display according to a preset grayscale and an initial common voltage value.

The operation S602 is to determine an image flicker value of the liquid crystal display panel.

The operation S603 is to determine whether the image flicker value satisfies a minimum flicker threshold, and if so, to proceed to the operation S604; otherwise, to proceed to the operation S605.

The operation S604 is to determine the initial common voltage value as an ideal common voltage value corresponding to the sub-pixels in the color.

The operation S605 is to adjust the initial common voltage value, to control the liquid crystal display panel again to display according to the preset grayscale corresponding to the color, and the adjusted initial common voltage value; to determine an image flicker value of the liquid crystal display panel again until it is determined that the determined image flicker value satisfies the minimum flicker threshold, and to determine the adjusted initial common voltage value as an ideal common voltage value corresponding to the sub-pixels in the color. Reference can be made to the operations S401 to S405 in the above embodiments for details thereof, and a repeated description thereof will be omitted here.

In some embodiments, determining the target common voltage value according to the proportions alternatively includes: determining the target common voltage value according to the determined ideal common voltage values and the determined proportions.

In some embodiments, determining the target common voltage value according to the determined ideal common voltage values and the proportions includes: determining the target common voltage value $V_{com2}$ in an equation of:

$$V_{com2} = \sum_{k=1}^{K} V_k * \lambda_k.$$

Where K represents a total number of colors, k represents an integer greater than or equal to 1, and less than or equal to K, $\lambda_k$ represents a proportion of the number of sub-pixels in one of the colors at nonzero grayscales, and $V_k$ represents an ideal common voltage value corresponding to the sub-pixels in the one of the colors.

In some embodiments, with M=3, $\lambda_1$ represents a proportion corresponding to the number of red sub-pixels at nonzero grayscales in an image to be displayed, and $V_1$ represents an ideal common voltage value corresponding to the red sub-pixels; $\lambda_2$ represents a proportion corresponding to the number of green sub-pixels at nonzero grayscales in the image to be displayed, and $V_2$ represents an ideal common voltage value corresponding to the green sub-pixels; and $\lambda_3$ represents a proportion corresponding to the number of blue sub-pixels at nonzero grayscales in the image to be displayed, and $V_3$ represents an ideal common voltage value corresponding to the blue sub-pixels, so that a value of $V_{com2}$ can be determined in an equation of $V_{com2}=V_1*\lambda_1+V_2*\lambda_2+V_3*\lambda_3$. Of course, the target common voltage value can alternatively be determined according to the proportions $\lambda_1$, $\lambda_1$, and $\lambda_3$, and the ideal common voltage values $V_1$, $V_2$, and $V_3$ through the method of difference, fitting, or approximation, etc., although the embodiments of the disclosure will not be limited thereto.

Figure 7:
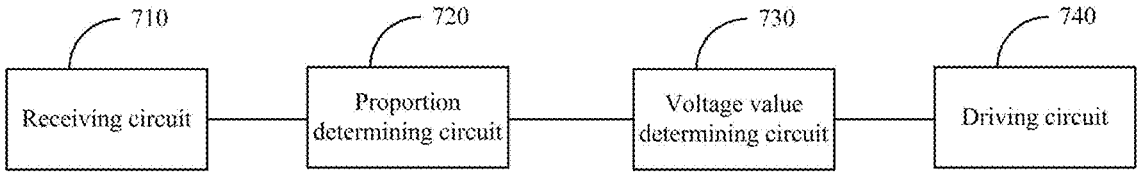
FIG. 7 is a first schematic structural diagram of a display control apparatus according to the embodiments of the disclosure.

Based upon the same inventive concept, the embodiments of the disclosure further provide a display control apparatus of a liquid crystal display panel, and as illustrated in FIG. 7, the apparatus includes: a receiving circuit 710 configured to receive data of a frame of image to be displayed; a proportion determining circuit 720 configured to determine proportions of the numbers of sub-pixels in respective colors at nonzero grayscales in the frame of image to be displayed, according to the data of the frame of image to be displayed; a voltage value determining circuit 730 configured to determine a target common voltage value according to the determined proportions; and a driving circuit 740 configured to output the target common voltage value to a common electrode to display an image.

In the display control apparatus according to the embodiments of the disclosure, an image can be controlled to be displayed on the liquid crystal display panel in such a way that the proportions of the numbers of sub-pixels in the respective colors at nonzero grayscales in the frame of image to be displayed are determined according to the data of the frame of image to be displayed, and further the optimum target common voltage value adapted to the frame of image to be displayed is determined according to the determined proportions, so that the image can be displayed on the LCD panel using the determined target common voltage value while the image is being switched, thus alleviating the problem of a flicker in the displayed image.

Figure 8:
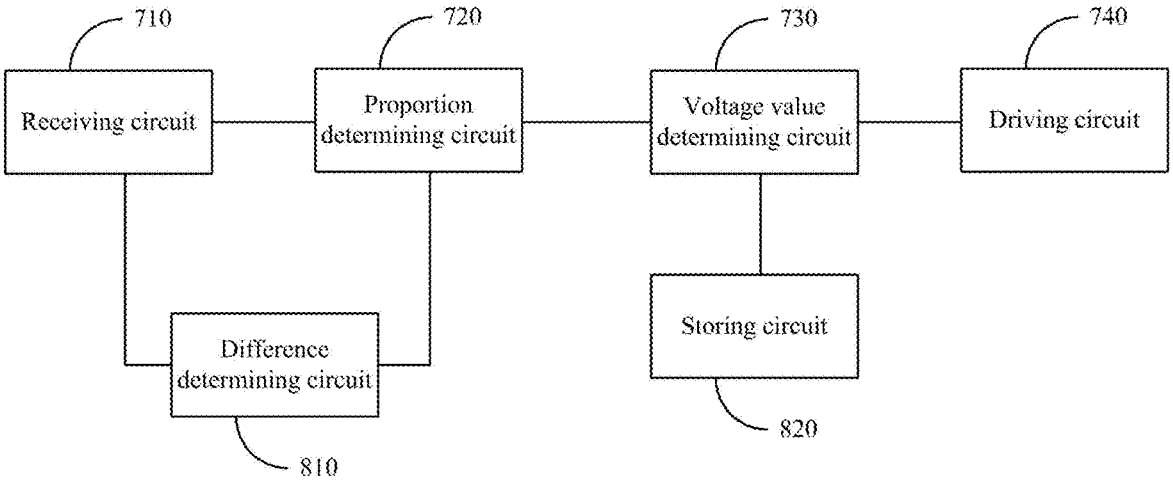
FIG. 8 is a second schematic structural diagram of the display control apparatus according to the embodiments of the disclosure.

In some embodiments, the data of the frame of image to be displayed are data of the (a+1)-th frame of image, where a is a positive integer; and in some embodiments, as illustrated in FIG. 8, the apparatus further includes: a difference determining circuit 810 configured to determine a difference between the data of the frame of image to be displayed, and data of the a-th frame of image; and the proportion determining circuit 720 is configured to determine the proportions of the numbers of sub-pixels in the respective colors at nonzero grayscales in the frame of image to be displayed, according to the data of the frame of image to be displayed, upon determining that the difference between the data of the frame of image to be displayed, and the data of the a-th frame of image does not lie in a preset difference range.

In some embodiments, in the display control apparatus according to the embodiments of the disclosure, as illustrated in FIG. 8, the display control apparatus further includes: a storing circuit 820 configured to store a pre-created correspondence table between proportions of the numbers of sub-pixels in respective colors at nonzero grayscales, and an optimum common voltage value; and the voltage value determining circuit 730 is configured to determine the target common voltage value according to the determined proportions and the pre-created correspondence table between the proportions of the numbers of sub-pixels in the respective colors at nonzero grayscales, and the optimum common voltage value. In some embodiments, the correspondence table between the proportions of the numbers of sub-pixels in the respective colors at nonzero grayscales, and the optimum common voltage value can be created in the operations as illustrated in FIG. 4 or FIG. 5.

In some embodiments, in the display control apparatus according to the embodiments of the disclosure, the display control apparatus further includes: an obtaining circuit (not illustrated) configured to determine ideal common voltage values corresponding to the sub-pixels in the respective colors before the data of the frame of image to be displayed are received; and the voltage value determining circuit 730 is configured to determine the target common voltage value according to the determined ideal common voltage values, and the determined proportions. In some embodiments, the ideal common voltage values corresponding to the sub-pixels in the respective colors can be determined in the operations as illustrated in FIG. 6.

In some embodiments, in the display control apparatus according to the embodiments of the disclosure, the storing circuit 820 is further configured to store the determined ideal common voltage values corresponding to the sub-pixels in the respective colors.

In some embodiments, in the display control apparatus according to the embodiments of the disclosure, the voltage value determining circuit 730 is configured to determine the target common voltage value $V_{com2}$ in an equation of:

$$V_{com2} = \sum_{k=1}^{K} V_k * \lambda_k.$$

Where K represents a total number of colors, k represents an integer greater than or equal to 1, and less than or equal to K, $\lambda_k$ represents a proportion of the number of sub-pixels in one of the colors at nonzero grayscales, and $V_k$ represents an ideal common voltage value corresponding to the sub-pixels in the one of the colors.

In some embodiments, in the display control apparatus according to the embodiments of the disclosure, the driving circuit 740 is configured to convert the data of the frame of image to be displayed, into grayscale voltage for displaying, and to convert the target common voltage value into common voltage for displaying; and to input the resulting grayscale voltage to pixel electrodes in the respective sub-pixels, and to output the resulting common voltage to the common electrode to display the image.

In some embodiments, in the display control apparatus according to the embodiments of the disclosure, the respective circuits above can be embodied in an all-hardware form or an all-software form or both.

In some embodiments, in the display control apparatus according to the embodiments of the disclosure, the receiving circuit 710, the proportion determining circuit 720 and the voltage value determining circuit 730 can be arranged in a TCON. The driving circuit 740 can include a source drive IC and a common voltage drive IC, where the source drive IC is configured to convert the data of the frame of image to be displayed, into grayscale voltage for displaying, and to output the grayscale voltage to pixel electrodes of the LCD panel, and the common voltage drive IC is configured to convert the target common voltage value into common voltage for displaying, and to output the common voltage to a common electrode of the LCD panel.

Based upon the same inventive concept, the embodiments of the disclosure further provide a display device including the display control apparatus above according to the embodiments of the disclosure. The display device addresses the problem under a similar principle to the display control apparatus above, so reference can be made to the implementation of the display control apparatus above for an implementation of the display device, and a repeated description thereof will be omitted here.

In some embodiments, the display device according to the embodiments of the disclosure can be a mobile phone, a tablet computer, a TV set, a monitor, a notebook computer, a digital photo frame, a navigator, or any other product or component with a display function. All the other components indispensable to the display device shall readily occur to those ordinarily skilled in the art, and a repeated description thereof will be omitted here, but the embodiments of the disclosure will not be limited thereto.

Based upon the same inventive concept, the embodiments of the disclosure further provide a computer readable storage medium on which computer readable program codes are stored, where the computer readable program codes are configured to enable a processor to perform the operations of the display control method above according to any one of the embodiments of the disclosure when the computer readable program codes run on the processor. In some embodiments, the disclosure can be embodied in the form of a computer program product embodied on one or more computer usable storage mediums (including but not limited to a disk memory, an optical memory, etc.) including computer readable program codes.

Based upon the same inventive concept, the embodiments of the disclosure further provide a computer device including a memory and at least one processor, where computer readable program codes are stored on the memory, and the at least one processor is configured to execute the computer readable program codes to perform the operations of the display control method above according to any one of the embodiments of the disclosure.

In the display control method and apparatus, the computer readable storage medium, and the computer device according to the embodiments of the disclosure, an image can be controlled to be displayed on the liquid crystal display panel in such a way that the proportions of the numbers of sub-pixels in the respective colors at nonzero grayscales in the frame of image to be displayed are determined according to the data of the frame of image to be displayed, and further the optimum target common voltage value adapted to the frame of image to be displayed is determined according to the determined proportions, so that an image can be displayed on the LCD panel using the determined target common voltage value while the image is being switched, thus alleviating the problem of a flicker in the displayed image.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A display control method, comprising:

receiving data of a frame of image to be displayed;

determining, for each color in a plurality of colors, a proportion of a number of sub-pixels in the each color at nonzero grayscales versus a number of sub-pixels in the plurality of colors at nonzero grayscales in the frame of image to be displayed, according to the data of the frame of image to be displayed;

determining a target common voltage value according to determined proportions for the plurality of colors and a pre-created correspondence table between the proportions and an optimum common voltage value; and outputting the target common voltage value to a common electrode to display the image;

wherein the correspondence table is pre-created by:

determining ideal common voltage values corresponding to the sub-pixels in the plurality of colors;

determining a current optimum common voltage value $V_{com1}$ corresponding to the proportions in an equation of:

$$V_{com1} = \sum_{m=1}^{M} V_m * \lambda_m;$$

wherein M represents a total number of the plurality of colors, m represents an integer greater than or equal to 1, and less than or equal to M, $\lambda_m$ represents the proportion of the number of sub-pixels in the each color at nonzero grayscales versus the number of sub-pixels in the plurality of colors at nonzero grayscales, $\lambda_m$ is less than 1, and $V_m$ represents an ideal common voltage value corresponding to the sub-pixels in the each color; and creating the correspondence table between the proportions and the optimum common voltage value according to the determined current optimum common voltage value;

wherein the data of the frame of image to be displayed are data of an (a+1)-th frame of image, wherein a is a positive integer; and after the data of the frame of image to be displayed are received, and before the proportions for the plurality of colors are determined according to the data of the frame of image to be displayed, the display control method further comprises:

determining a difference between the data of the frame of image to be displayed, and data of the a-th frame of image; and said determining the proportion of the number of sub-pixels in the each color at nonzero grayscales versus the number of sub-pixels in the plurality of colors at nonzero grayscales in the frame of image to be displayed, according to the data of the frame of image to be displayed comprises:

determining the proportion of the number of sub-pixels in the each color at nonzero grayscales versus the number of sub-pixels in the plurality of colors at nonzero grayscales in the frame of image to be displayed, according to the data of the frame of image to be displayed, upon determining that the difference between the data of the frame of image to be displayed, and the data of the a-th frame of image does not lie in a preset difference range.

2. The display control method according to claim 1, wherein the creating the correspondence table between the proportions and the optimum common voltage value according to the determined current optimum common voltage value comprises:

determining a common voltage output value corresponding to the current optimum common voltage value according to a plurality of different preset intervals of common voltage output values, and the determined current optimum common voltage value; and creating the correspondence table between the proportions and the optimum common voltage value according to the determined common voltage output value.

3. The display control method according to claim 1, wherein before the data of the frame of image to be displayed are received, the display control method further comprises:

determining ideal common voltage values corresponding to the sub-pixels in the plurality of colors; and determining the target common voltage value according to the determined proportions comprises:

determining the target common voltage value according to the determined ideal common voltage values, and the determined proportions.

4. The display control method according to claim 3, wherein determining the target common voltage value according to the determined ideal common voltage values, and the determined proportions comprises:

determining the target common voltage value in an equation of:

$$V_{com2} = \sum_{k=1}^{K} V_k * \lambda_k;$$

wherein K represents a total number of the plurality of colors, k represents an integer greater than or equal to 1, and less than or equal to K, $\lambda_k$ represents the proportion of the number of sub-pixels in the each color at nonzero grayscales versus the number of sub-pixels in the plurality of colors at nonzero grayscales, and $V_k$ represents an ideal common voltage value corresponding to the sub-pixels in the each color.

5. The display control method according to claim 1, wherein said determining the ideal common voltage values corresponding to the sub-pixels in the plurality of colors comprises:

controlling, for sub-pixels in the each color, a liquid crystal display panel to display according to a preset grayscale and an initial common voltage value;

determining an image flicker value of the liquid crystal display panel;

determining whether the image flicker value satisfies a minimum flicker threshold; and determining the initial common voltage value as an ideal common voltage value corresponding to the sub-pixels in the each color, upon determining that the image flicker value satisfies the minimum flicker threshold; or in response to determining that the image flicker value does not satisfy the minimum flicker threshold, adjusting the initial common voltage value, and controlling the liquid crystal display panel again to display according to the preset grayscale corresponding to the each color, and the adjusted initial common voltage value, determining an image flicker value of the liquid crystal display panel again until it is determined that the determined image flicker value satisfies the minimum flicker threshold, and determining the adjusted initial common voltage value as an ideal common voltage value corresponding to the sub-pixels in the each color.

6. The display control method according to claim 5, wherein the display control method further comprises: determining the minimum flicker threshold by:

selecting a preset number of liquid crystal display panels;

debugging respective selected liquid crystal display panels, and determining debug common voltage values corresponding to smallest image flicker values of the respective selected liquid crystal display panels; and determining the minimum flicker threshold according to the determined debug common voltage values corresponding to the respective selected liquid crystal display panels.

7. A non-transitory computer readable storage medium, wherein computer readable program codes are stored on the non-transitory computer readable storage medium, and the computer readable program codes are configured to enable a processor to perform operations of claim 1, when the computer readable program codes run on the processor.

8. A computer device, comprising a memory and at least one processor, wherein computer readable program codes are stored on the memory, and the at least one processor is configured to execute the computer readable program codes to perform operations of claim 1.

9. A display control apparatus, comprising:

a receiving circuit configured to receive data of a frame of image to be displayed;

a proportion determining circuit configured to determine, for each color in a plurality of colors, a proportion of a number of sub-pixels in the each color at nonzero grayscales versus a number of sub-pixels in the plurality of colors at nonzero grayscales in the frame of image to be displayed, according to the data of the frame of image to be displayed;

a voltage value determining circuit configured to determine a target common voltage value according to determined proportions;

a driving circuit configured to output the target common voltage value to a common electrode to display the image;

a correspondence table pre-creating circuit configured to pre-create a correspondence table between the proportions and an optimum common voltage value; and a storing circuit configured to store the correspondence table;

wherein the voltage value determining circuit is configured to determine the target common voltage value according to the determined proportions, and the pre-created correspondence table between the proportions and the optimum common voltage value; and wherein the correspondence table pre-creating circuit is configured to:

determine ideal common voltage values corresponding to the sub-pixels in the plurality of colors;

determine a current optimum common voltage value $V_{com1}$ corresponding to the proportions in an equation of:

$$V_{com1} = \sum_{m=1}^{M} V_m * \lambda_m;$$

wherein M represents a total number of the plurality of colors, m represents an integer greater than or equal to 1, and less than or equal to M, $\lambda_m$ represents the proportion of the number of sub-pixels in the each color at nonzero grayscales versus the number of sub-pixels in the plurality of colors at nonzero grayscales, $\lambda_m$ is less than 1, and $V_m$ represents an ideal common voltage value corresponding to the sub-pixels in the each color; and create the correspondence table between the proportions and the optimum common voltage value according to the determined current optimum common voltage value;

wherein the data of the frame of image to be displayed are data of an (a+1)-th frame of image, wherein a is a positive integer; and the display control apparatus further comprises:

a difference determining circuit configured to determine a difference between the data of the frame of image to be displayed, and data of the a-th frame of image; and the proportion determining circuit is configured to determine the proportion of the number of sub-pixels in the each color at nonzero grayscales versus the number of sub-pixels in the plurality of colors at nonzero grayscales in the frame of image to be displayed, according to the data of the frame of image to be displayed, upon determining that the difference between the data of the frame of image to be displayed, and the data of the a-th frame of image does not lie in a preset difference range.

10. The display control apparatus according to claim 9, wherein the display control apparatus further comprises: an obtaining circuit configured to determine ideal common voltage values corresponding to the sub-pixels in the plurality of colors; and the voltage value determining circuit is configured to determine the target common voltage value according to the determined ideal common voltage values, and the determined proportions.

11. The display control apparatus according to claim 10, wherein the voltage value determining circuit is configured to determine the target common voltage value $V_{com2}$ in an equation of:

$$V_{com2} = \sum_{k=1}^{K} V_k * \lambda_k;$$

wherein K represents a total number of the plurality of colors, k represents an integer greater than or equal to 1, and less than or equal to K, $\lambda_k$ represents the proportion of the number of sub-pixels in the each color at nonzero grayscales versus the number of sub-pixels in the plurality of colors at nonzero grayscales, and $V_k$ represents an ideal common voltage value corresponding to the sub-pixels in the each color.

12. A display device, comprising a display control apparatus; wherein the display control apparatus comprises:

a receiving circuit configured to receive data of a frame of image to be displayed;

a proportion determining circuit configured to determine, for each color in a plurality of colors, a proportion of a number of sub-pixels in the each color at nonzero grayscales versus a number of sub-pixels in the plurality of colors at nonzero grayscales in the frame of image to be displayed, according to the data of the frame of image to be displayed;

a voltage value determining circuit configured to determine a target common voltage value according to determined proportions;

a driving circuit configured to output the target common voltage value to a common electrode to display the image;

a correspondence table pre-creating circuit configured to pre-create a correspondence table between the proportions and an optimum common voltage value; and a storing circuit configured to store the correspondence table;

wherein the voltage value determining circuit is configured to determine the target common voltage value according to the determined proportions, and the pre-created correspondence table between the proportions and the optimum common voltage value; and wherein the correspondence table pre-creating circuit is configured to:

determine ideal common voltage values corresponding to the sub-pixels in the plurality of colors;

determine a current optimum common voltage value $V_{com1}$ corresponding to the proportions in an equation of:

$$V_{com1} = \sum_{m=1}^{M} V_m * \lambda_m;$$

wherein M represents a total number of the plurality of colors, m represents an integer greater than or equal to 1, and less than or equal to M, $\lambda_m$ represents the proportion of the number of sub-pixels in the each color at nonzero grayscales versus the number of sub-pixels in the plurality of colors at nonzero grayscales, $\lambda_m$ is less than 1, and $V_m$ represents an ideal common voltage value corresponding to the sub-pixels in the each color; and create the correspondence table between the proportions and the optimum common voltage value according to the determined current optimum common voltage value;

wherein the data of the frame of image to be displayed are data of an (a+1)-th frame of image, wherein a is a positive integer; and the display control apparatus further comprises:

a difference determining circuit configured to determine a difference between the data of the frame of image to be displayed, and data of the a-th frame of image; and the proportion determining circuit is configured to determine the proportion of the number of sub-pixels in the each color at nonzero grayscales versus the number of sub-pixels in the plurality of colors at nonzero grayscales in the frame of image to be displayed, according to the data of the frame of image to be displayed, upon determining that the difference between the data of the frame of image to be displayed, and the data of the a-th frame of image does not lie in a preset difference range.

13. The display device according to claim 12, wherein the display control apparatus further comprises: an obtaining circuit configured to determine ideal common voltage values corresponding to the sub-pixels in the plurality of colors; and the voltage value determining circuit is configured to determine the target common voltage value according to the determined ideal common voltage values, and the determined proportions.

* * * * *